US006970147B2

(12) United States Patent
Ishizuka et al.

(10) Patent No.: US 6,970,147 B2
(45) Date of Patent: Nov. 29, 2005

(54) DRIVE APPARATUS FOR A PLASMA DISPLAY PANEL AND A DRIVE METHOD THEREOF

(75) Inventors: Mitsuhiro Ishizuka, Tokyo (JP); Takatoshi Shoji, Tokyo (JP)

(73) Assignee: Pioneer Corporation, Tokyo (JP)

( * ) Notice: Subject to any disclaimer, the term of this patent is extended or adjusted under 35 U.S.C. 154(b) by 77 days.

(21) Appl. No.: 10/131,048

(22) Filed: Apr. 25, 2002

(65) Prior Publication Data

US 2002/0158822 A1 Oct. 31, 2002

(30) Foreign Application Priority Data

Apr. 26, 2001 (JP) ..... 2001-130292

(51) Int. Cl.[7] ..... G09G 3/28

(52) U.S. Cl. ..... 345/63; 345/60; 345/37

(58) Field of Search ..... 345/60, 63, 84, 345/87, 95, 37, 53–54, 41

(56) References Cited

U.S. PATENT DOCUMENTS

| | | | | |
|---|---|---|---|---|
| 6,396,508 | B1 * | 5/2002 | Noecker | 345/693 |
| 6,608,609 | B1 * | 8/2003 | Setoguchi et al. | 345/60 |
| 2001/0005188 | A1 * | 6/2001 | Watanabe | 345/60 |
| 2002/0057234 | A1 * | 5/2002 | Ishizuka et al. | 345/77 |

FOREIGN PATENT DOCUMENTS

JP 2000-214822 A 8/2000

* cited by examiner

*Primary Examiner*—Amr A. Awad
*Assistant Examiner*—Alecia D. Nelson
(74) *Attorney, Agent, or Firm*—Morgan Lewis & Bockius LLP

(57) ABSTRACT

The driving apparatus for a plasma display panel is formed by a first priming pulse generation circuit for generating a first priming pulse having a first crest value; a second priming pulse generation circuit for generating a second priming pulse having a second crest value; and a drive control means for selectively controlling the first priming pulse generation circuit so as to output the first priming pulse and second priming pulse generation circuit so as to output the second priming pulse in accordance with a detection result obtained from the intensity detection means.

4 Claims, 8 Drawing Sheets

DRIVE APPARATUS FOR A PLASMA DISPLAY PANEL AND A DRIVE METHOD THEREOF

BACKGROUND OF THE INVENTION

1. Field of the Invention

The present invention relates to a method for driving a plasma display panel, and more particularly to a method for driving a plasma display panel which provides an AC (Alternating Current) discharge type display.

2. Related Art

In general, a plasma display panel (hereinafter, abbreviated as PDP) has a number of features including thin structure, flicker-free, large display contrast ratio, comparatively large screen, high response speed, spontaneous light emitting type, possible multiple color light emission by use of phosphors. For this reason, they have come into wide use in recent years in the field of displays for computers and color image displays and the like. PDPs can be classified according to operating principle into an AC type, having dielectric-covered electrodes and operate by indirect AC discharge, and DC type, in which the electrodes are exposed in the discharge space and which operates by DC discharge. AC types can be further classified into a memory operating type that uses a memory of the discharge cell as a drive method, and a refresh-type that does not use this memory. The intensity of a PDP is proportional to the number of discharges, that is, to the number of pulse voltage repetitions. With respect to the above refresh type, when a display capacity increases, the luminescence is lowered. Thus, such a PDP is mainly used as a PDP with its small display capacity.

FIG. 1 is a schematic perspective view illustrating a configuration of one display cell of a conventional AC memory operation type PDP. This display cell is made up of two glass insulation substrates 1 and 2, at the rear and front, respectively, a scanning electrode 3 and a sustaining electrode 4, with trace electrodes 5 and 6 superposed thereover for the purpose of reducing the electrode resistance, a data electrode 7 formed on the insulation substrate 1 so as to perpendicularly cross the canning electrode 3 and the sustaining electrode 4, a discharge gas space 8, filled with a discharge gas that is helium, neon, or xenon, or a mixture thereof, in the space between the insulation substrates 1 and 2, a bulkhead wall 9 for the purpose of establishing the discharge gas space 8 and partitioning the display cell, a phosphor 11 for converting the ultraviolet light generated by a discharge in the discharge gas to a visible light 10, a dielectric film 12 covering the scanning electrode 3 and the sustaining electrode 4, a protective layer 13 made of magnesium oxide or the like, which protects the dielectric film 12 from electrical discharge, and a dielectric electrode 14 covering the data electrode 7.

FIG. 2 of the accompanying drawings shows in schematic form the electrode placement in an AC-type plasma display panel. The scanning electrodes S and the sustaining electrodes C are each mutually parallel, and the data electrodes D perpendicularly cross the scanning electrodes S and the sustaining electrodes C to form the cells that emit light. One cell is formed by one scanning electrode, one sustaining electrode, and one data electrode. The number of cells over an entire screen is therefore the product n×m, where n is the number of scanning electrodes and m is the number of data electrodes.

The drive operation of a PDP configured as noted above is described below, with reference made to FIG. 3 of the accompanying drawings.

Time period 1 of FIG. 3 is a priming period, during which a priming pulse Ppr-s is applied to the scanning electrodes and a waveform thereof is a saw toothed pulse, and a priming pulse Ppr-c is applied to the sustaining electrodes, and a waveform thereof is a rectangular waveform. During the priming period, the positive polarity saw toothed pulse applied to the scanning electrodes and the negative polarity rectangular pulse applied to the sustaining electrodes generate a priming discharge in the discharge space between the scanning electrodes and the sustaining electrodes of all cells, activated particles are generated that facilitate the generation of cell discharge, simultaneously with which negative and positive wall charges become attached over the scanning electrodes and the sustaining electrodes, respectively.

The discharge in the above-noted case is a weak discharge performed at a point at which the potential difference between surface discharge electrodes exceeds the discharge triggering voltage. Period 2 is a priming erasing period, during which a priming erasing pulse Ppe-s for reducing the wall charges that had become attached to the scanning electrodes and the sustaining electrodes during the priming period is applied to the scanning electrodes, the waveform thereof being a gradually falling negative waveform. Period 3 is a scanning period, during which a negative polarity scanning pulse Psc applied to the scanning electrodes and a positive polarity data pulse Pd applied to the data electrodes pause a writing discharge, thereby generated wall charges become attached to the cells at locations at which light is to be emitted in a subsequent sustaining period. This writing discharge during a scanning period is only generated at the intersection of a scanning electrode to which the scan pulse Psc is applied and a data electrode to which the data pulse Pd is applied.

When a discharge occurs, a wall charge becomes attached to the scanning electrodes and the sustaining electrodes. In contrast to this, a cell in which discharge did not occur has no wall charge attached thereto. Period 4 is a sustaining period, during which positive sustaining pulses Psus-s and Psus-c are applied to the scanning electrodes and the sustaining electrodes alternately, starting at the sustaining electrodes. In doing this, a wall charge becomes attached to a cell selectively written during the scanning period, a positive sustaining pulse voltage and the wall charge voltage being weighted to each other, so that a potential difference between electrodes exceeds a minimum discharge voltage, thereby a discharge occurs. Once the discharge is generated, a wall charge is disposed so as to cancel the voltage applied to each electrode. Therefore, a negative charge is accumulated on the sustaining electrodes C, and a positive charge is accumulated on the scan electrodes S.

In the next sustaining pulse, a positive voltage pulse is applied to the scan electrodes S, and weighting relevant to a wall charge is generated in the scan electrodes S, a potential difference between the electrodes exceeds a minimum discharge voltage, and a discharge is generated. Then, in the sustaining period, the sustaining pulses Psus-c and Psus-s are repeatedly applied, thereby the light emission of a selected display cells is sustained. On the other hand, because the wall charge at a cell at which a writing discharge did not occur is extremely small, even if a sustaining pulse is applied, no sustaining discharge occurs. Period 5 is a sustaining erasing period, during which a sustaining erasing pulse Pe-s is applied so as to reduce the wall charge that had become attached to the scanning electrodes and the sustaining electrodes during the sustaining period, the waveform thereof being a gradually falling negative waveform at the scanning electrode side. The five periods of priming, priming erasing, scanning, sustaining, and sustaining erasing are collectively referred to as a sub-field.

As noted above, because the priming discharge is performed over the entire screen, however, there is a slightly noticeable light emitted from cells which are not driven, thereby resulting in a lowering of the contrast relative to the non-display portions. It is possible to reduce the emitted light intensity (priming intensity) during priming by lowering the priming voltage. FIG. 4 shows the relationship between the priming intensity and the priming voltage. If the final voltage that the priming voltage reaches is lowered for the purpose of reducing the priming intensity, however, this will lead to an increase in the data voltage. FIG. 5 shows the relationship between the priming voltage and the data voltage. If the priming voltage is decreased, therefore, it is necessary to increase the data voltage, and there are cases in which there are problems such as an increase in the power consumption and an increase in the cost of the driver IC (Integrated Circuit).

Because the data voltage must be increased as the screen load increases, if the priming voltage is lowered, when the screen load becomes large there are the problems of insufficient data voltage to cause a writing discharge, and an increase in the cost of the driver IC.

Accordingly, it is an object of the present invention to provide a drive method and drive circuit for a plasma display panel which enables a reduction in the priming intensity without causing an increase in the data voltage.

SUMMARY OF THE INVENTION

In order to achieve the above-noted object, the present invention adopts the following basic technical constitution.

Specifically, the first aspect of the present invention is a driving apparatus for a plasma display panel having a sustaining electrode and a scanning electrode comprising: an intensity detection means for detecting an average intensity of a display image to be displayed on the plasma display panel; a first priming pulse generation circuit for generating a first priming pulse having a first crest value which is applied between the sustaining electrode and scanning electrode in a priming period for driving the plasma display panel; a second priming pulse generation circuit for generating a second priming pulse having a second crest value which is applied between the sustaining electrode and scanning electrode in the priming period for driving the plasma display panel; and a drive control means for selectively controlling the first priming pulse generation circuit so as to output the first priming pulse and second priming pulse generation circuit so as to output the second priming pulse in accordance with a detection result obtained from the intensity detection means.

In the second aspect of the present invention, the drive control means controls so that the first priming pulse generation circuit outputs the first priming pulse, in a case in which the intensity detection means detects that the average intensity of the display image to be displayed is higher than a prescribed intensity; and the drive control means controls so that the second priming pulse generation circuit outputs the second priming pulse, a crest value of which is smaller than that of the first priming pulse, in a case in which the intensity detection means detects that the average intensity of the display image to be displayed is lower than the prescribed intensity.

The third aspect of the present invention is a driving apparatus for a plasma display panel having a sustaining electrode and a scanning electrode comprising: an intensity detection means for detecting an average intensity of a display image to be displayed on the plasma display panel; a priming pulse generation circuit for generating a first priming pulse having a first pulse width and a second priming pulse having a second pulse width which are applied between the sustaining electrode and scanning electrode, respectively, in a priming period for driving the plasma display panel; and a drive control means for controlling the priming pulse generation circuit so as to selectively output the first priming pulse or second priming pulse in accordance with a detection result obtained from the intensity detection means.

In the fourth aspect of the present invention, the drive control means controls the priming pulse generation circuit so as to output the first priming pulse, in a case in which the intensity detection means detects that the average intensity of the display image to be displayed is higher than a prescribed intensity; and the drive control means controls the priming pulse generation circuit so as to output the second priming pulse, a pulse width of which is smaller than that of the first priming pulse, in a case in which the intensity detection means detects that the average intensity of the display image to be displayed is lower than the prescribed intensity.

BRIEF DESCRIPTIONS OF THE DRAWINGS

DETAILED DESCRIPTION OF THE PREFERRED EMBODIMENTS

Embodiments of the present invention are described in detail below, with reference made to relevant accompanying drawings.

(First Embodiment)

Figure 1:
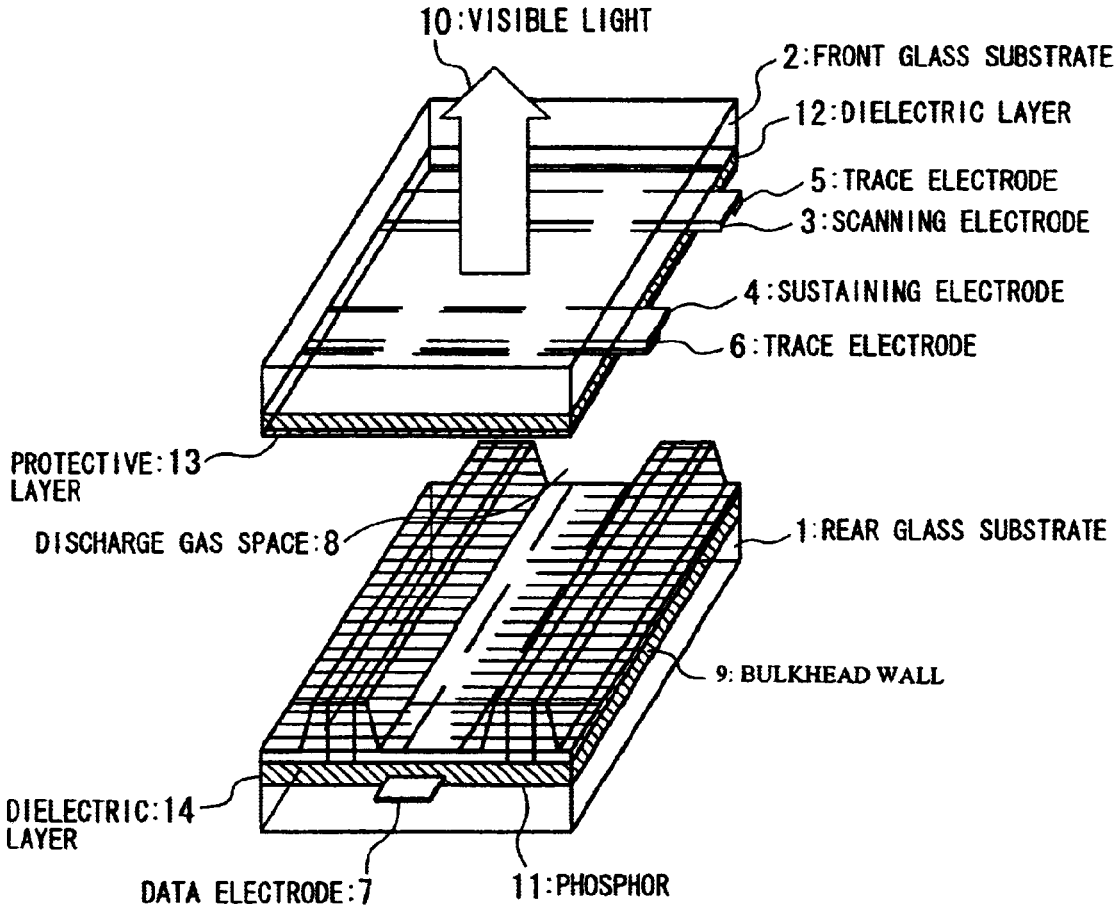
FIG. 1 PRIOR ART
FIG. 1 is an exploded perspective view illustrating a configuration of one display cell of a conventional AC memory operation type PDP.
Figure 2:
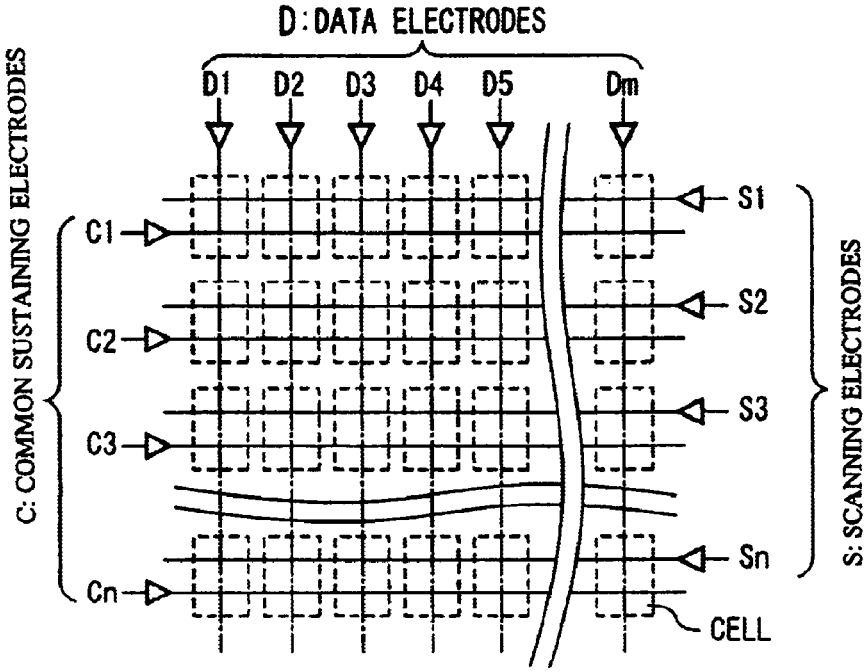
FIG. 2 PRIOR ART
FIG. 2 is a plan view showing the electrode placement in an AC plasma display panel in FIG. 1.
Figure 3:
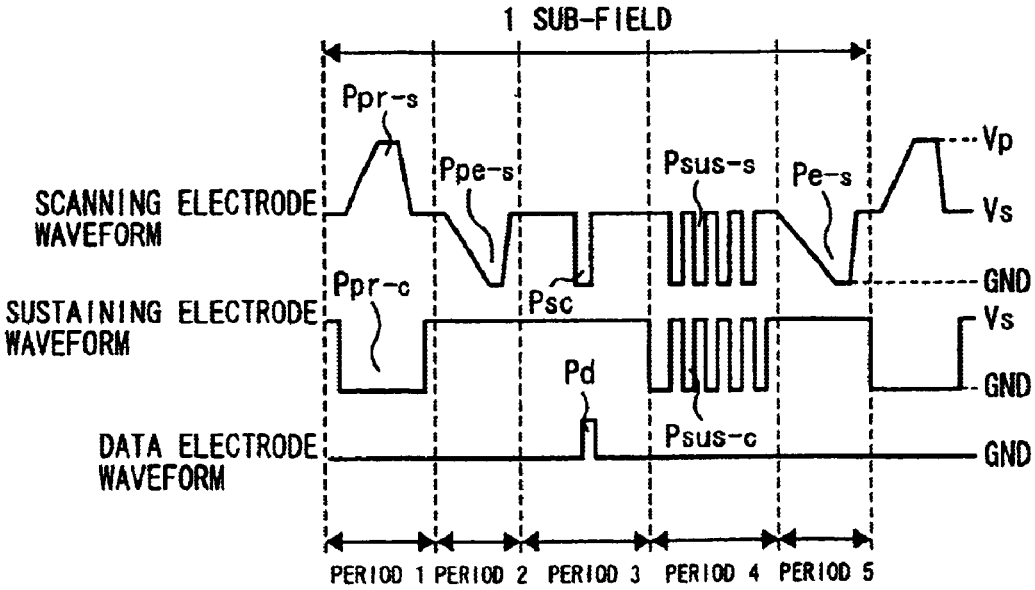
FIG. 3 PRIOR ART
FIG. 3 is a timing diagram showing the drive waveforms used in the prior art.
Figure 4:
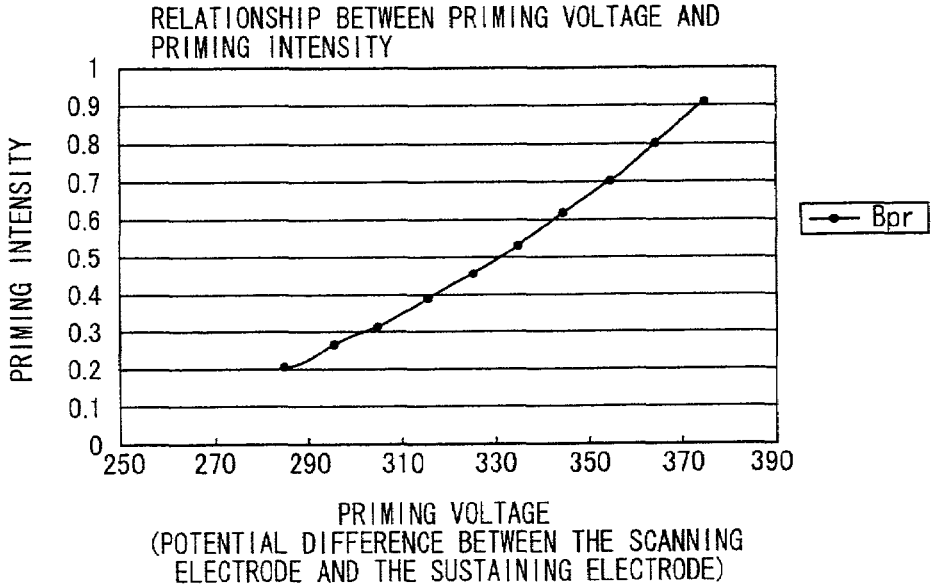
FIG. 4 PRIOR ART
FIG. 4 is a graph showing the relationship between the priming intensity and the priming voltage in the prior art.
Figure 5:
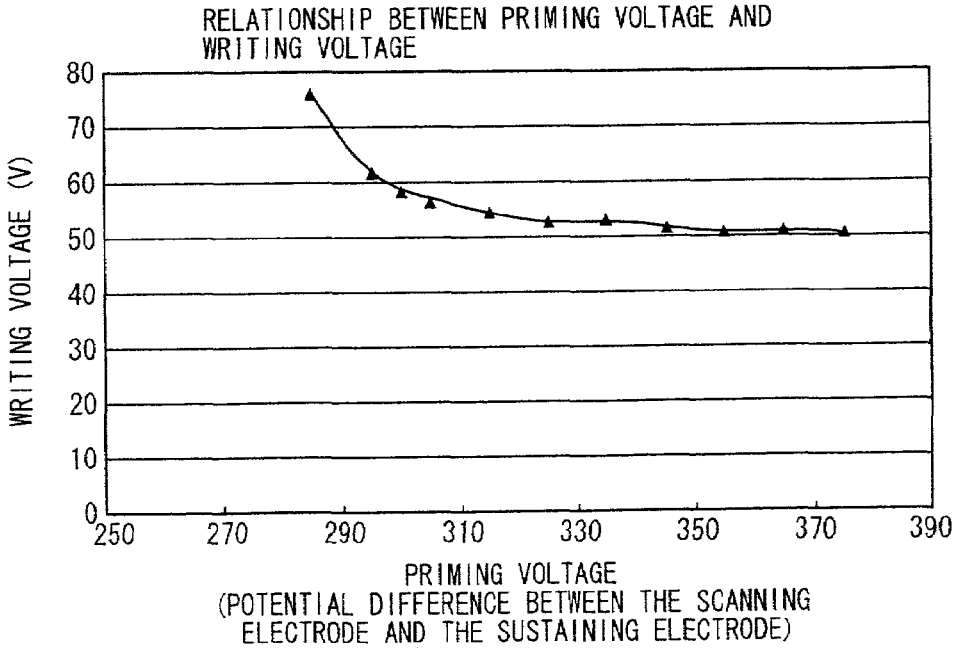
FIG. 5 PRIOR ART
FIG. 5 is a graph showing the relationship between the priming voltage and the data voltage in the prior art.

A first embodiment of the present invention is described below, with references made to FIG. 6 through FIG. 8. The basic configuration of the plasma display driving apparatus of this embodiment is the same as that of the conventional plasma display shown in FIG. 1 and FIG. 2, wherein the cells emitting light are disposed at intersections between the scanning electrodes S and sustaining electrodes C, which are provided in parallel with each other, and the data electrodes D which are provided so as to be perpendicularly intersecting therewith.

Figure 6A:
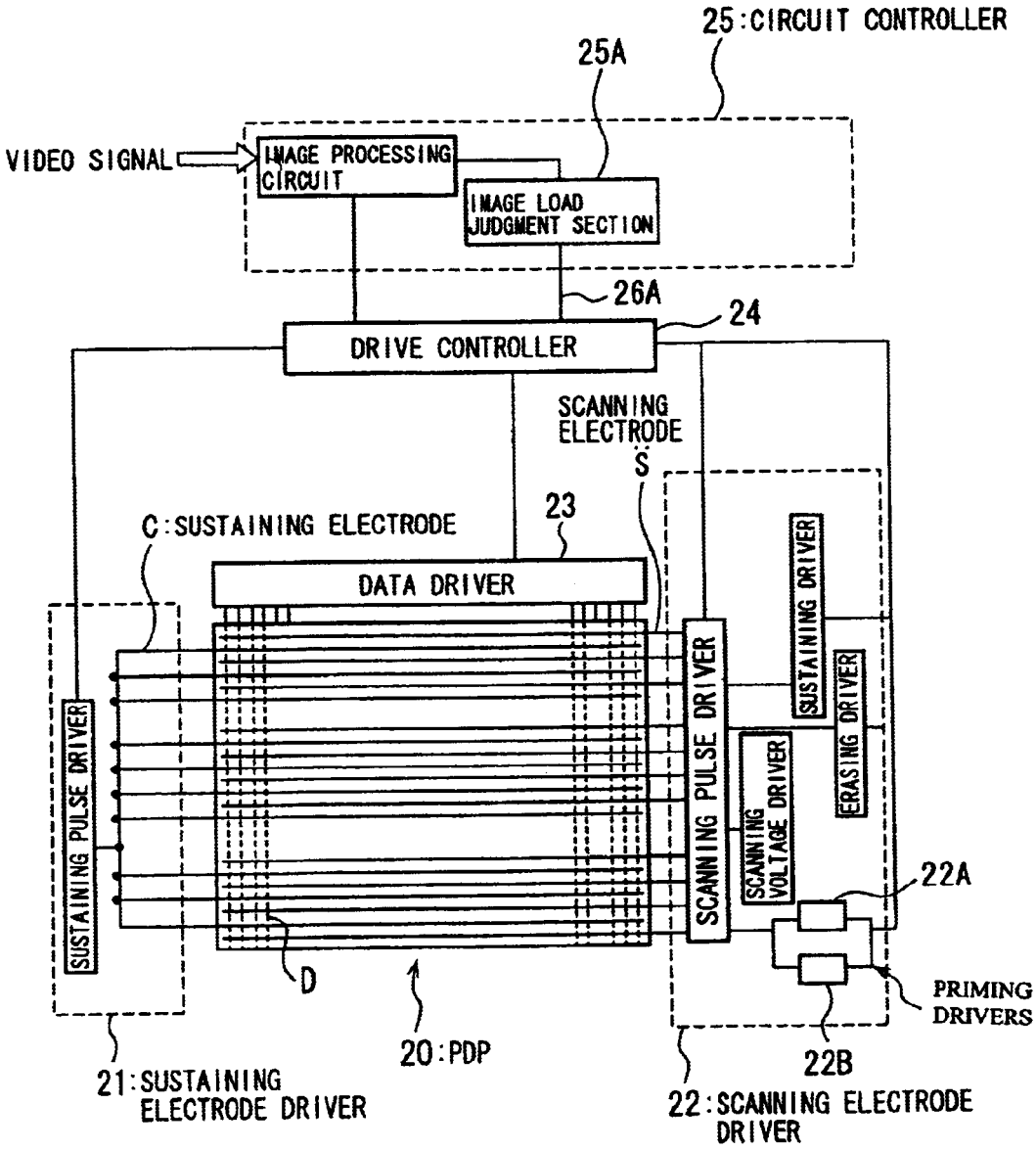
FIG. 6(A) is a block diagram showing a first embodiment of the present invention.
Figure 6B:
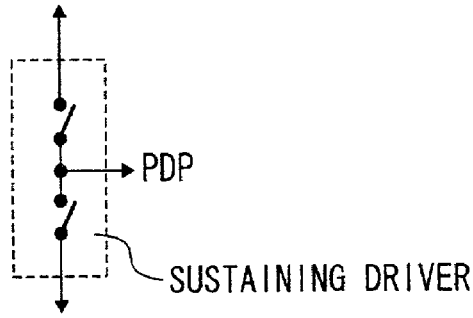
FIG. 6(B) is a circuit diagram showing a driving circuit of a sustaining electrode.
Figure 6C:
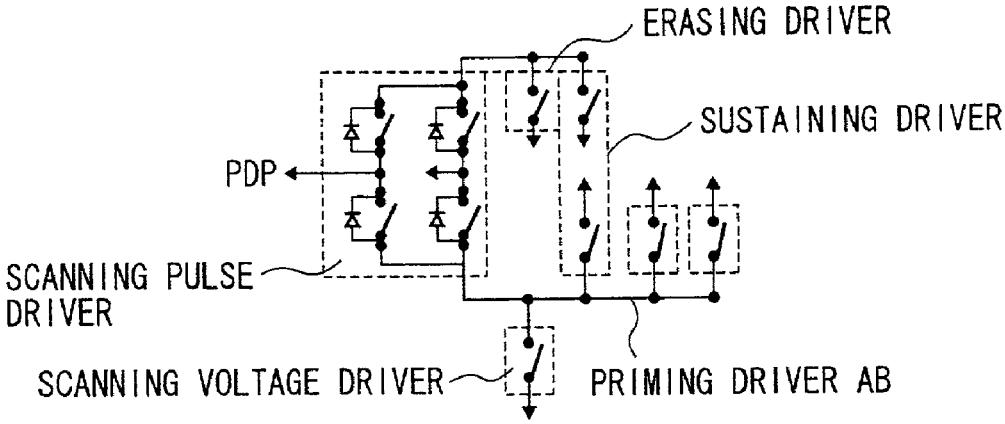
FIG. 6(C) is a circuit diagram showing a driving circuit of a scan electrode.
Figure 6D:
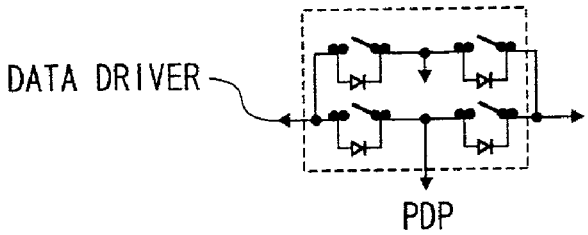
FIG. 6(D) is a circuit diagram showing a data driver.

FIG. 6(A) is a drawing showing a block diagram of a first embodiment of the present invention. FIG. 6(B) is a circuit diagram showing a driving circuit of a sustaining electrode. FIG. 6(C) is a circuit diagram showing a driving circuit of a scan electrode. FIG. 6(D) is a circuit diagram showing a data driver. A plasma display panel according to the present invention has a plasma display panel 20 shown in FIG. 1 and FIG. 2, a sustaining electrode driver 21 applying a voltage to a sustaining electrode C of the plasma display, a scanning electrode driver 22 applying a voltage to a scanning electrode S of the plasma display, a data driver 23 applying a voltage to a data electrode D of the plasma display, a drive controller 24 controlling these drivers 21, 22, 23, and a circuit controller 25, to which a video signal is input and controlling the drive controller 24.

The priming drivers 22A, 22B, provided in the scanning electrode driver 22, are circuits for generating a priming pulse, the priming driver 22A being used for generating a priming pulse in a case in which the load of the display panel 20 is heavy, that is, the average intensity of priming driver 22B being used for generating a priming pulse in a case in which the load of the display panel 20 is light, that is, the average intensity of images to be displayed on the PDP is low. An image load judgment section 25A provided in the circuit controller 25 controls the priming drivers 22A, 22B. That is, the image load judgment section 25A judges whether the average intensity of images to be displayed on the PDP is high. Other circuits of the present invention are same as that of the conventional PDP.

Figure 7:
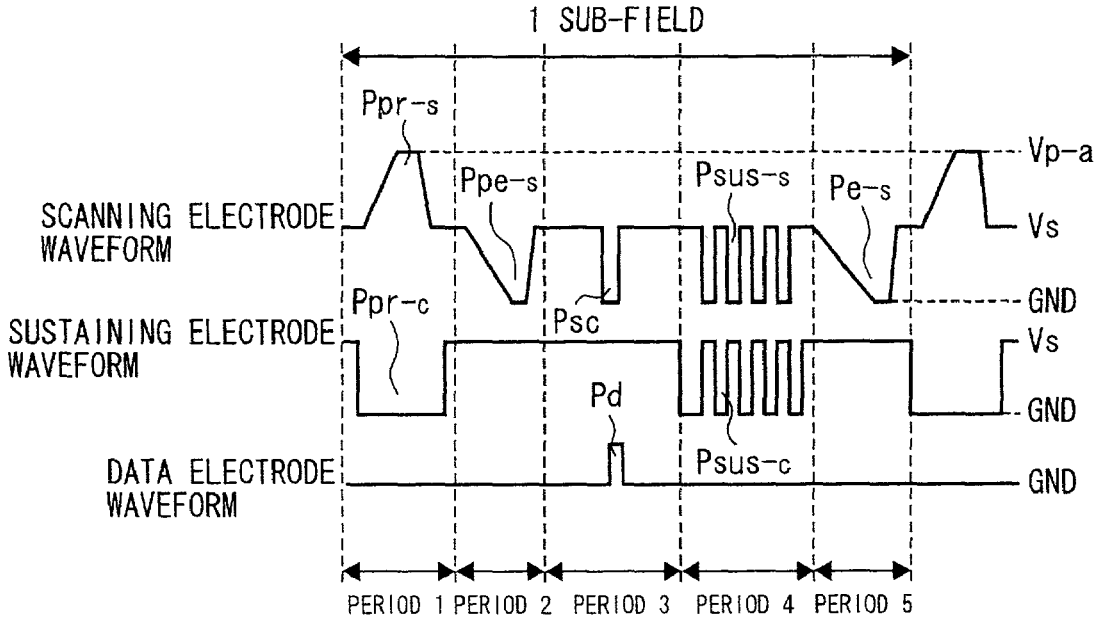
FIG. 7 is a timing diagram for the case of a heavy display load in the first embodiment of the present invention.
Figure 8:
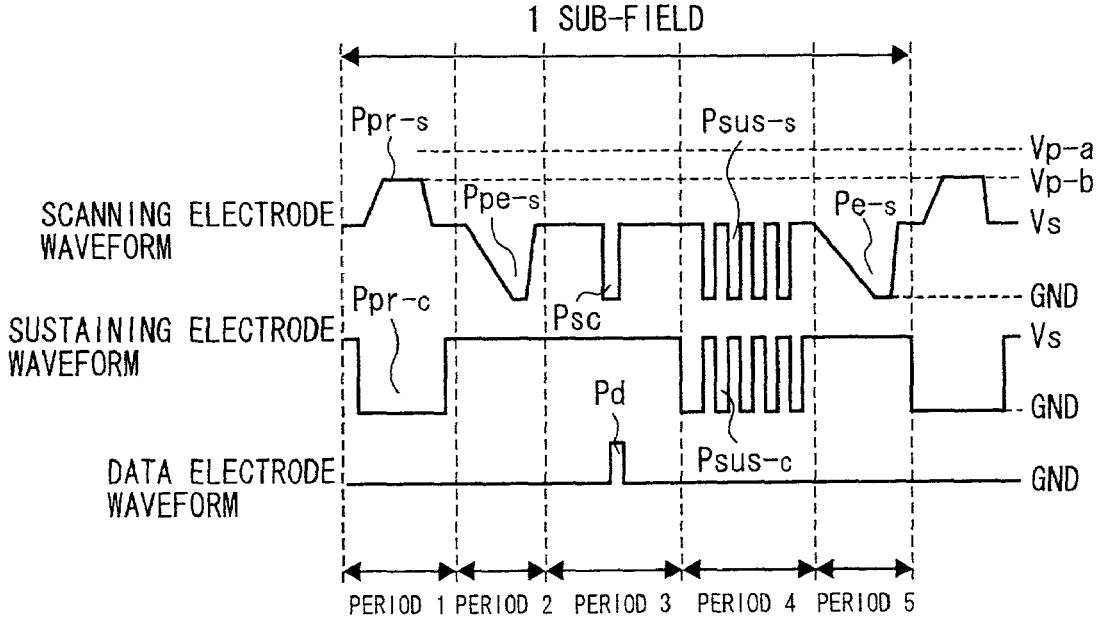
FIG. 8 is a timing diagram for the case of a light display load in the first embodiment of the present invention.

FIG. 7 and FIG. 8 show the drive waveforms in this embodiment. FIG. 7 shows the drive waveforms in the case of a heavy display load, and FIG. 8 shows the drive waveforms in the case of a light display load. Period 1 is the priming period, during which the priming pulse Ppr-s is applied to the scanning electrodes S, and a waveform thereof is a saw toothed waveform, and the priming pulse Ppr-c is applied to the sustaining electrodes C, and a waveform thereof is a rectangular waveform. The voltage of the priming pulses Ppr-s applied in this case is controlled, based on image load information 26A judged by the image load judgment section 25A of FIG. 6(A), so that prescribed amount of wall charge is attached to the scanning electrodes S and the sustaining electrodes C in accordance with the state of the load.

As shown in FIG. 7, in the case of a heavy display load the voltage of the priming pulses Ppr-s is controlled to become the voltage Vp-z, and as shown in FIG. 8, in the case of a light display load the voltage of the priming pulses Ppr-s is controlled to become the voltage Vp-b.

Period 2 is a priming erasing period, during which a priming erasing pulse Ppe-s for reducing the wall charges that had become attached to the scanning electrodes S and the sustaining electrodes C during the priming period is applied to the scanning electrodes S, the waveform thereof being a gradually falling negative waveform.

Period 3 is a scanning period, during which a negative polarity scanning pulse Psc applied to the scanning electrodes and a positive polarity data pulse Pd applied to the data electrodes cause a writing discharge, thereby generated wall charges become attached to the cells at locations at which light is to be emitted in a subsequent sustaining period. This writing discharge during a scanning period is only generated at the intersection of a scanning electrode to which the scan pulse Psc is applied and a data electrode to which the data pulse Pd is applied.

When this is done, because a prescribed amount of wall charges required to generate a write discharge is obtained on the data electrodes D during the priming period, the constant data voltage is applied to data electrodes D, regardless of the state of the display load. At cells at which a discharge occurs, there is a negative charge at the sustaining electrode and a positive charge at the scanning electrode. On the contrary, at cells at which a discharge did not occur, there is only an extremely small wall charge at both the scanning and sustaining electrodes.

Period 4 is a sustaining period, during which positive sustaining pulses Psus-s and Psus-c are applied to the scanning electrodes and the sustaining electrodes alternately, starting at the sustaining electrodes. In doing this, a wall charge becomes attached to a cell selectively written during the scanning period, a positive sustaining pulse voltage and the wall charge voltage being weighted to each other, so that a potential difference between electrodes exceeds a minimum discharge voltage, thereby a discharge occurs. Once the discharge is generated, a wall charge is disposed so as to cancel the voltage applied to each electrode. Therefore, a negative charge is accumulated on the sustaining electrodes C, and a positive charge is accumulated on the scan electrodes S.

In the next sustaining pulse, a positive voltage pulse is applied to the scan electrodes S, and weighting relevant to a wall charge is generated in the scan electrodes S, a potential difference between the electrodes exceeds a minimum discharge voltage, and a discharge is generated. Then, in the sustaining period, the sustaining pulses Psus-c and Psus-s are repeatedly applied, thereby the light emission of a selected display cells is sustained. On the other hand, because the wall charge at a cell at which a writing discharge did not occur is extremely small, even if a sustaining pulse is applied, no sustaining discharge occurs.

Period 5 is a sustaining erasing period, during which a sustaining erasing pulse Pe-s is applied so as to reduce the wall charge that had become attached to the scanning electrodes and the sustaining electrodes during the sustaining period, the waveform thereof being a gradually falling negative waveform at the scanning electrode side.

As describe above, by controlling the voltage of the priming pulse in response to the image display, the amount of wall charge on the data electrodes is controlled, it is possible to obtain a constant data voltage required for writing discharge, regardless of the display load. For this reason, it is possible to reduce the voltage of the priming pulse when there is a light display load, thereby reducing the intensity in black areas of the display in a display with a light display load, having large black areas, making it possible to achieve a display with the improved display contrast.

(Second Embodiment)

Figure 9:
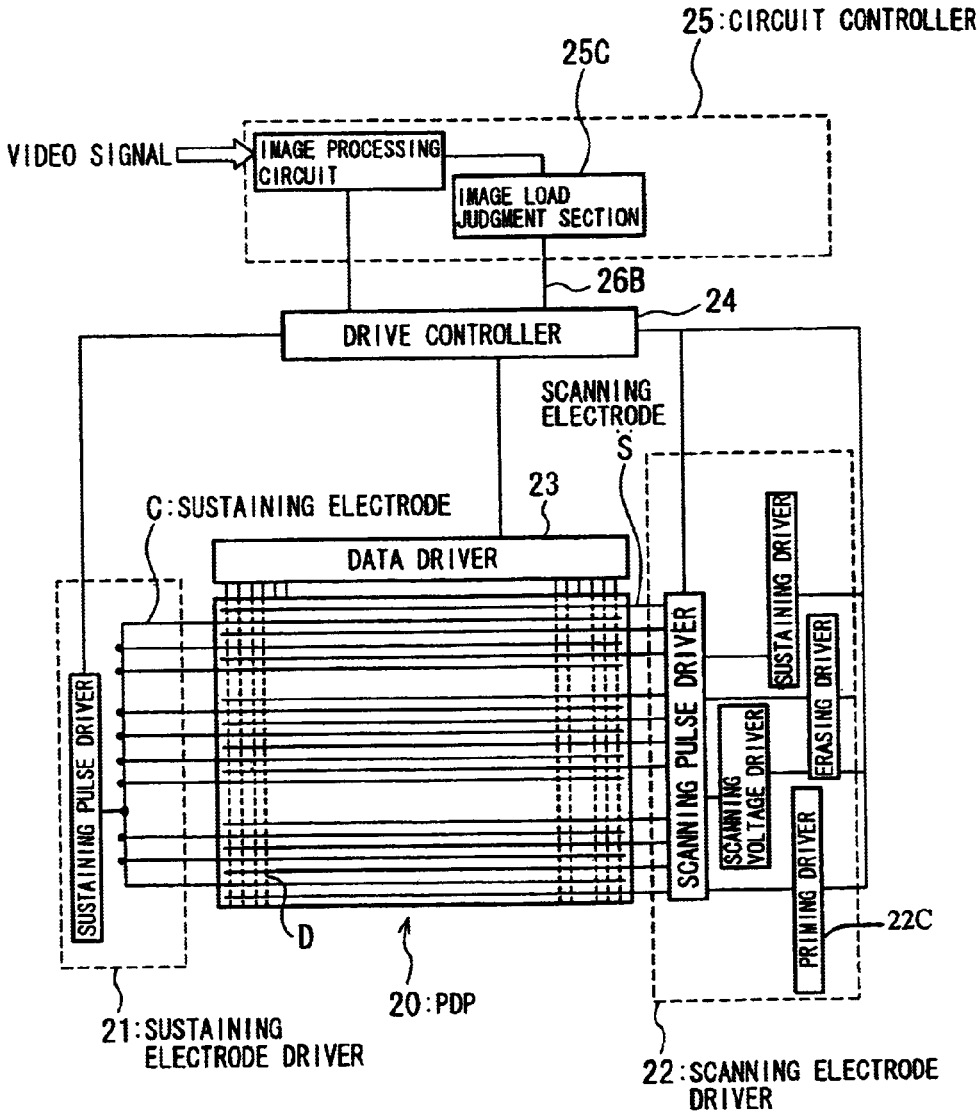
FIG. 9 is a block diagram showing a second embodiment of the present invention.

A second embodiment of the present invention is described below, with references made to FIG. 9 through FIG. 11. FIG. 9 is a drawing showing a block diagram of a second embodiment of the present invention. The priming driver 22C is provided for generating the priming pulse, although this embodiment differs from the first embodiment in which it does not have a plurality of priming pulse circuits. Other features of the circuit are the same as those of the first embodiment.

Figure 10:
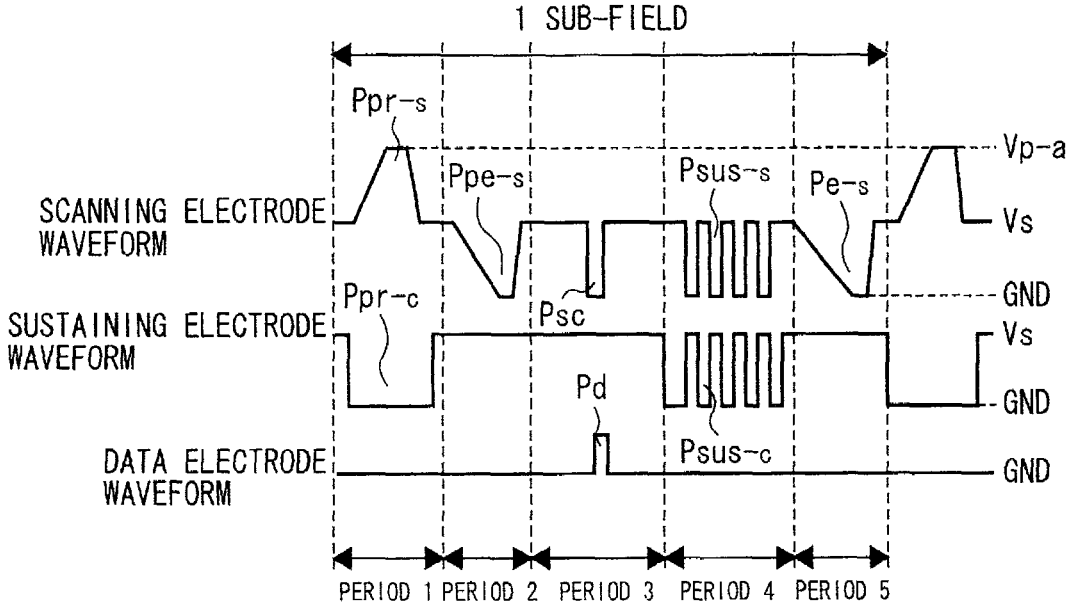
FIG. 10 is a timing diagram for the case of a heavy display load in the second embodiment of the present invention.
Figure 11:
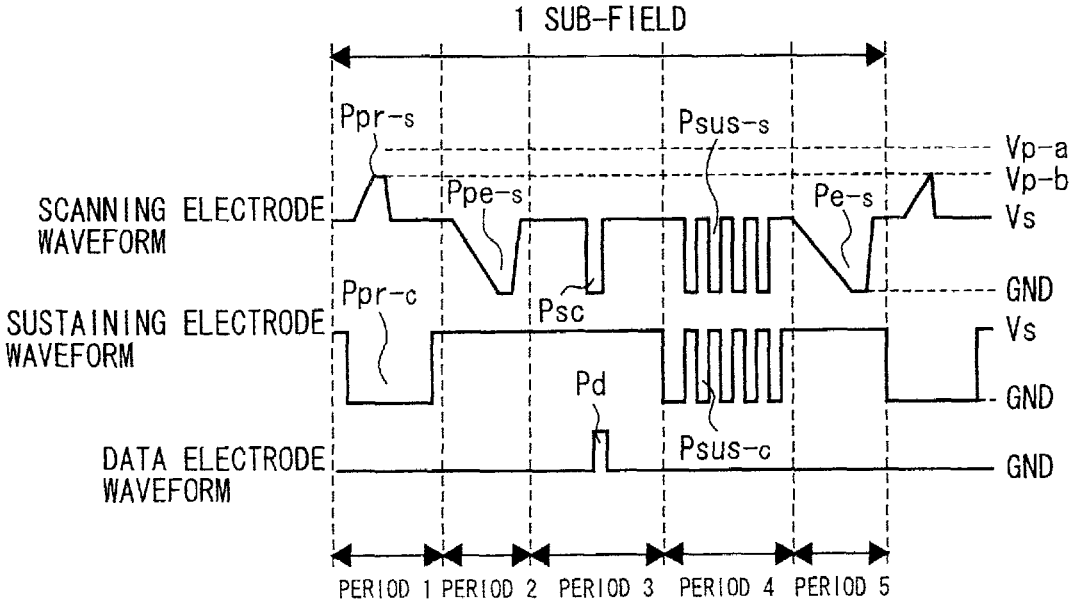
FIG. 11 is a timing diagram for the case of a light display load in the second embodiment of the present invention.

FIG. 10 and FIG. 11 show the drive waveforms in this embodiment. FIG. 10 shows the drive waveforms in the case of a heavy display load, and FIG. 11 shows the drive waveforms in the case of a light display load. Period 1 is the priming period, during which the priming pulse Ppr-s is applied to the scanning electrodes S, and a waveform thereof is a saw toothed waveform, and the priming pulse Ppr-c is applied to the sustaining electrodes C, and a waveform thereof is a rectangular waveform. The voltage Vp-a of the priming pulses Ppr-s applied in this case is set to values so that a writing discharge occurs at a prescribed data voltage in the case of a heavy display load. Based on the image load information 26B judged by the image load judgment section 25C shown in FIG. 9, the width of the priming pulse Ppr-s is controlled, so that prescribed amount of wall charge is attached to the scanning electrodes S and the sustaining electrodes C at that display load.

In the saw toothed waveform, the voltage thereof rises linearly so that it is easy to obtain the voltage Vp-a by controlling the pulse width. In the case of a light display load, as shown in FIG. 11, the voltage Vp-b is obtained by controlling the width of the priming pulse Ppr-s.

Period 2 is a priming erasing period, during which a priming erasing pulse Ppe-s for reducing the wall charges that had become attached to the scanning electrodes S and the sustaining electrodes C during the priming period is applied to the scanning electrodes S, the waveform thereof being a gradually falling negative waveform.

Period 3 is a scanning period, during which a negative polarity scanning pulse Psc applied to the scanning electrodes and a positive polarity data pulse Pd applied to the data electrodes cause a writing discharge, thereby generated wall charges become attached to the cells at locations at which light is to be emitted in a subsequent sustaining period. This writing discharge during a scanning period is only generated at the intersection of a scanning electrode to which the scan pulse Psc is applied and a data electrode to which the data pulse Pd is applied.

When this is done, because a prescribed amount of wall charges required to generate a write discharge is obtained on the data electrodes D during the priming period, the constant data voltage is applied to data electrodes D, regardless of the state of the display load. At cells at which a discharge occurs, there is a negative charge at the sustaining electrode and a positive charge at the scanning electrode. On the contrary, at cells at which a discharge did not occur, there is only an extremely small wall charge at both the scanning and sustaining electrodes.

Period 4 is a sustaining period, during which positive sustaining pulses Psus-s and Psus-c are applied to the scanning electrodes and the sustaining electrodes alternately, starting at the sustaining electrodes. In doing this, a wall charge becomes attached to a cell selectively written during the scanning period, a positive sustaining pulse voltage and the wall charge voltage being weighted to each other, so that a potential difference between electrodes exceeds a minimum discharge voltage, thereby a discharge occurs. Once the discharge is generated, a wall charge is disposed so as to cancel the voltage applied to each electrode. Therefore, a negative charge is accumulated on the sustaining electrodes C, and a positive charge is accumulated on the scan electrodes S.

In the next sustaining pulse, a positive voltage pulse is applied to the scan electrodes S, and weighting relevant to a wall charge is generated in the scan electrodes S, a potential difference between the electrodes exceeds a minimum discharge voltage, and a discharge is generated. Then, in the sustaining period, the sustaining pulses Psus-c and Psus-s are repeatedly applied, thereby the light emission of a selected display cells is sustained. On the other hand, because the wall charge at a cell at which a writing discharge did not occur is extremely small, even if a sustaining pulse is applied, no sustaining discharge occurs.

Period 5 is a sustaining erasing period, during which a sustaining erasing pulse Pe-s is applied so as to reduce the wall charge that had become attached to the scanning electrodes and the sustaining electrodes during the sustaining period, the waveform thereof being a gradually falling negative waveform at the scanning electrode side.

As described above, the amount of wall charge placed on the data electrodes is controlled by changing the pulse width of the priming pulse in accordance with the display load, thereby obtaining a constant data voltage required for a writing discharge. It is therefore possible to reduce the voltage of the priming pulse when there is a light display load, thereby reducing the intensity in black areas of the display in a display with a light display load, having large black areas, making it possible to achieve a display with improved contrast, this effect being equivalent to that achieved by the first embodiment. Because the change in voltage is made by merely controlling the width of the priming pulse, there is need for only one priming pulse circuit, thereby achieving the effect of reducing the circuit cost, in comparison with the first embodiment.

By changing the voltage of the priming pulse in responsive to load presented by an input image and adjusting the amount of wall charge on the data electrodes, it is possible to reduce the priming voltage when the image load is light. By doing this, the intensity in large black display areas when the display load is light is reduced, thereby achieving the effect of obtaining a high-quality display with improved contrast.

Another effect achieved by the present invention is that, by varying the voltage by merely changing the width of the priming pulse, it is possible to vary the priming voltage without the additional circuitry that would be required in the case of using the priming pulse drive circuit of the prior art.

What is claimed is:

1. A driving apparatus for a plasma display panel having a sustaining electrode driver, a data electrode driver and a scanning electrode driver comprising:

an intensity detection means for detecting an average intensity of a display image to be displayed on said plasma display panel;

a first priming pulse generation circuit, provided in the scanning electrode driver, for generating a first priming pulse having a first crest value which is applied between said sustaining electrode and scanning electrode in a priming period for driving said plasma display panel;

a second priming pulse generator circuit, provided in said scanning electrode driver, for generating a second priming pulse having a second crest value which is applied between said sustaining electrode and scanning electrode in said priming period for driving said plasma display panel; and a drive control means for selectively controlling said first priming pulse generation circuit so as to output said first priming pulse and second priming pulse generation circuit so as to output said second priming pulse in accordance with a detection result obtained from said intensity detection means, wherein said drive control means controls said first priming pulse generation circuit to output said first priming pulse, in a case in which said intensity detection means detects that said average intensity of said display image to be displayed is higher than a prescribed intensity; and said drive control means controls said second priming pulse generation circuit to output said second priming pulse, a crest value of which is smaller than that of said first priming pulse, in a case in which said intensity detection means detects that said average intensity of said display image to be displayed is lower than said prescribed intensity, thereby maintaining a constant amount of wall charges on data electrodes generated by priming discharge regardless of changes in magnitude of a display load.

2. A driving apparatus for a plasma display panel having a sustaining electrode driver, a data electrode driver and a scanning electrode driver comprising:

an intensity detection means for detecting an average intensity of a display image to be displayed on said plasma display panel;

a priming pulse generation circuit, provided in the scanning electrode driver, for generating a first priming pulse having a first pulse width and a second priming pulse having a second pulse width which are applied between said sustaining electrode and scanning electrode, respectively, in a priming period for driving said plasma display panel; and a drive control means for controlling said priming pulse generation circuit so as to selectively output said first priming pulse or said second priming pulse in accordance with a detection result obtained from said intensity detection means, wherein said drive control means controls said priming pulse generation circuit so as to output said first priming pulse, in a case in which said intensity detection means detects that said average intensity of said display image to be displayed is higher than a prescribed intensity, and said drive control means controls said priming pulse generation circuit so as to output said second priming pulse, a pulse width of which is smaller than that of said first priming pulse, in a case in which said intensity detection means detects that said average intensity of said display image to be displayed is lower than said prescribed intensity, thereby maintaining a constant amount of wall charges on data electrodes generated by priming discharge regardless of changes in magnitude of a display load.

3. A driving method for a plasma display panel having a sustaining electrode driver, a data electrode driver and a scanning electrode driver comprising the steps of:

detecting an average intensity of a display image to be displayed on said plasma display panel;

generating a first priming pulse in a first priming pulse generation circuit located in the scanning electrode driver having a first crest value in case of detecting that said average intensity of said display image to be displayed is higher than a prescribed intensity in said detecting step;

generating a second priming pulse in a second priming pulse generation circuit located in the said scanning electrode driver having a second crest value, a crest value of which is smaller than that of said first priming pulse, in case of detecting that said average intensity of said display image to be displayed is lower than said prescribed intensity in said detecting step; and applying said first priming pulse or second priming pulse between said sustaining electrode and scanning electrode in a priming period, thereby maintaining a constant amount of wall charges on data electrodes generated by priming discharge regardless of changes in magnitude of display load.

4. A driving method for a plasma display panel having a sustaining electrode driver, a data electrode driver and a scanning electrode driver comprising the steps of:

detecting an average intensity of a display image to be displayed on said plasma display panel;

generating a first priming pulse in a priming pulse generation circuit located in the scanning electrode driver having a first pulse width in case of detecting that said average intensity of said display image to be displayed is higher than a prescribed intensity in said detecting step;

generating a second priming pulse in said priming pulse generation circuit located in said scanning electrode driver, a pulse width of which is narrower than that of said first priming pulse, in case of detecting that said average intensity of said display image to be displayed is lower than said prescribed intensity in said detecting step; and applying said first priming pulse or second priming pulse between said sustaining electrode and scanning electrode in a priming period, thereby maintaining a constant amount of wall charges on data electrodes generated by priming discharge regardless of changes in magnitude of display load.

* * * * *